US007455243B2

(12) United States Patent
Coldren et al.

(10) Patent No.: US 7,455,243 B2
(45) **Date of Patent: *Nov. 25, 2008**

(54) ELECTRONIC UNIT INJECTOR WITH PRESSURE ASSISTED NEEDLE CONTROL

(75) Inventors: Dana R. Coldren, Fairbury, IL (US); Mingchun Dong, Bloomington, IL (US); Michael R. Huffman, Pontiac, IL (US)

(73) Assignee: Caterpillar Inc., Peoria, IL (US)

( * ) Notice: Subject to any disclaimer, the term of this patent is extended or adjusted under 35 U.S.C. 154(b) by 548 days.

This patent is subject to a terminal disclaimer.

(21) Appl. No.: 10/792,169

(22) Filed: Mar. 3, 2004

(65) Prior Publication Data

US 2005/0194462 A1 Sep. 8, 2005

(51) Int. Cl.
*F02M 47/02* (2006.01)
*F02D 1/06* (2006.01)

(52) U.S. Cl. ..... 239/5; 239/88; 239/96; 239/533.4

(58) Field of Classification Search ..... 239/88, 239/5, 95, 96, 533.4, 585.1, 585.2
See application file for complete search history.

(56) References Cited

U.S. PATENT DOCUMENTS 5,551,398 A 9/1996 Gibson et al.
5,711,279 A 1/1998 Green et al.
5,893,350 A 4/1999 Timms
5,915,623 A 6/1999 Knight et al.
6,012,430 A 1/2000 Cooke
6,267,306 B1 7/2001 Phillips et al.
6,390,070 B2 5/2002 Coldren et al.
6,502,555 B1 1/2003 Harcombe et al.
6,557,779 B2 * 5/2003 Perr et al. ..... 239/96
6,595,189 B2 7/2003 Coldren et al.
6,843,434 B2 * 1/2005 Lawrence et al. ..... 239/533.2
7,111,613 B1 * 9/2006 Barnes et al. ..... 123/467
7,134,616 B2 * 11/2006 Dong et al. ..... 239/533.8
2003/0127532 A1 7/2003 Coldren et al.

FOREIGN PATENT DOCUMENTS

EP 1316717 A2 * 6/2003

* cited by examiner

*Primary Examiner*—Christopher S Kim
(74) *Attorney, Agent, or Firm*—Liell & McNeil

(57) ABSTRACT

An electronically controlled fuel injector includes a reduced part count and complexity over similar fuel injectors without a substantial reduction in performance capabilities. This is accomplished by using a one-piece needle that is hydraulically balanced and biased toward a closed position with a spring positioned in the needle control chamber. Although subtle, this injector has some ability to control the fuel pressure when the needle valve is opening and closing by adjusting a relative timing of a pressure control valve opening relative to a needle control chamber, using separate electrical actuators. The invention is particularly applicable to fuel injectors that cycle through high and low pressure states during and between injection events, respectively. Cam actuated fuel injectors being particularly well suited.

10 Claims, 5 Drawing Sheets

ELECTRONIC UNIT INJECTOR WITH PRESSURE ASSISTED NEEDLE CONTROL

TECHNICAL FIELD

The present invention relates generally to electronically controlled fuel injectors, and more particularly to pressure assisted needle control in fuel injectors that cycle through high and low pressure states during and between injection events, respectively.

BACKGROUND

Over the years, cam actuated fuel injectors have become increasingly complex in a search for ever expanding performance capabilities. The same is true for other types of fuel injectors including hydraulically actuated and common rail injectors with admission valves. In general, a fuel injection system with a broader range of capabilities is able to increase engine performance while at the same time reducing undesirable exhaust emissions, including particulate matter, unburned hydro-carbons, $NO_x$, etc. One of the first innovations in improving the capabilities of cam actuated fuel injectors was to include an electronically controlled spill valve. This innovation is shown in many prior art references and allowed for some independence in injection timing from that dictated by a rotating cam lobe whose position was generally fixed with respect to the engine's crank shaft. Much later, a newer innovation was included that provided direct control over the injector's needle valve, to open and close the nozzle outlets at a selected timing that was somewhat independent of the pressurized state of the fuel injector.

For instance, co-owned U.S. Pat. No. 5,551,398 to Gibson et al. teaches a cam actuated fuel injector with electronic control over both pressurization via an electronically controlled spill valve and electronic control over injection timing via a separate needle control valve. Directly controlled fuel injectors generally have a needle valve that includes a closing hydraulic surface exposed to fluid pressure in a needle control chamber. A separate electronically controlled needle control valve can be actuated or deactuated to change the pressure conditions in the needle control chamber. When pressure is high in the needle control chamber, the needle stays in, or moves toward, its closed position. When pressure is low in the needle control chamber, the needle will lift to its open position, provided that fuel in the injector is above a needle valve opening pressure that can overcome a spring bias tending to hold the needle valve member in its closed position. This reference teaches a typical aspect of the conventional wisdom with regard to directly controlling needle valves in that steps are taken to minimize the volume of the needle control chamber in order to increase fluid tightness in the control circuit and hasten the needle's response to the control valve's movement. In other words, because fuel is not incompressible, there must inherently be some delay when raising the pressure in the needle control chamber to compress the fluid therein. As a consequence of this volume minimizing strategy, the needle's biasing spring must often be located at a different location outside of the needle control chamber. While the fuel injector taught in this reference shows considerable promise, it includes an increased complexity and part count in order to produce its superior performance.

Another cam actuated fuel injector is taught in U.S. Pat. No. 5,893,350 to Timms. This reference teaches the use of a single electrical actuator to control both pressurization through a spill valve and needle control via a needle control valve. While this fuel injector deletes one electrical actuator, it inherently couples injection timing to fuel pressurization and also suffers from an inability to do substantial end of injection rate shaping, which is more recently becoming recognized as a means by which emissions can be further reduced. In other words, this injector shows little ability to control the fuel pressure at the timing in which the needle valve closes at the end of an injection event.

The present invention is directed to an improved compromise between cost, complexity and part count on one hand and performance capabilities on the other hand.

SUMMARY OF THE INVENTION

In one aspect, a fuel injector includes an injector body with a needle valve seat and defines a nozzle chamber, a single nozzle outlet set and a needle control chamber. A one-piece needle valve member is positioned in the injector body and is moveable between a closed position in contact with the needle valve seat to close the single nozzle outlet set, and an open position out of contact with the needle valve seat to open the single nozzle outlet set. The one-piece needle valve member includes a closing hydraulic surface exposed to fluid pressure in the needle control chamber. The one piece needle valve member has an effective opening hydraulic surface area in its open position that is equal to an effective area of the closing hydraulic surface. A biasing spring is positioned in the needle control chamber and is operably coupled to bias the one-piece needle valve member toward its closed position. An electronically controlled pressure control valve is attached to the injector body and has a first position in which the nozzle chamber is fluidly connected to a spill passage, and a second position in which the nozzle chamber is closed to the spill passage. An electronically controlled needle control valve is attached to the injector body and has a first position in which the needle control chamber is fluidly connected to a low pressure passage, and a second position in which the needle control chamber is closed to the low pressure passage. First and second electrical actuators are attached to the injector body and are operably coupled to actuate the electronically controlled pressure control valve and the electronically controlled needle control valve, respectively.

In another aspect, a method of injecting fuel from a fuel injector includes a step of raising fuel pressure in a nozzle chamber at least in part by energizing a first electrical actuator. A single nozzle outlet set is opened at a selected timing at least in part by positioning a needle control valve at a first position that fluidly connects a needle control chamber to a low pressure passage. The single nozzle outlet set is closed at a selected timing after the opening step using one of at least three available end modes. In a first end mode, the first electrical actuator is de-energized to move the pressure control valve to a first position that opens the nozzle chamber to the spill passage while maintaining the needle control valve in its first position. In a second end mode, pressure forces on the needle valve member are equalized to move the needle valve member toward a closed position with a spring force by moving the needle control valve to a second position that fluidly closes the needle control chamber to the low pressure passage before energizing the first electrical actuator. In a third end mode, the pressure forces on the needle valve member are equalized to move the needle valve member toward its closed position with the spring force by moving the needle control valve to the second position after de-energizing the first electrical actuator.

DETAILED DESCRIPTION

Figure 1:
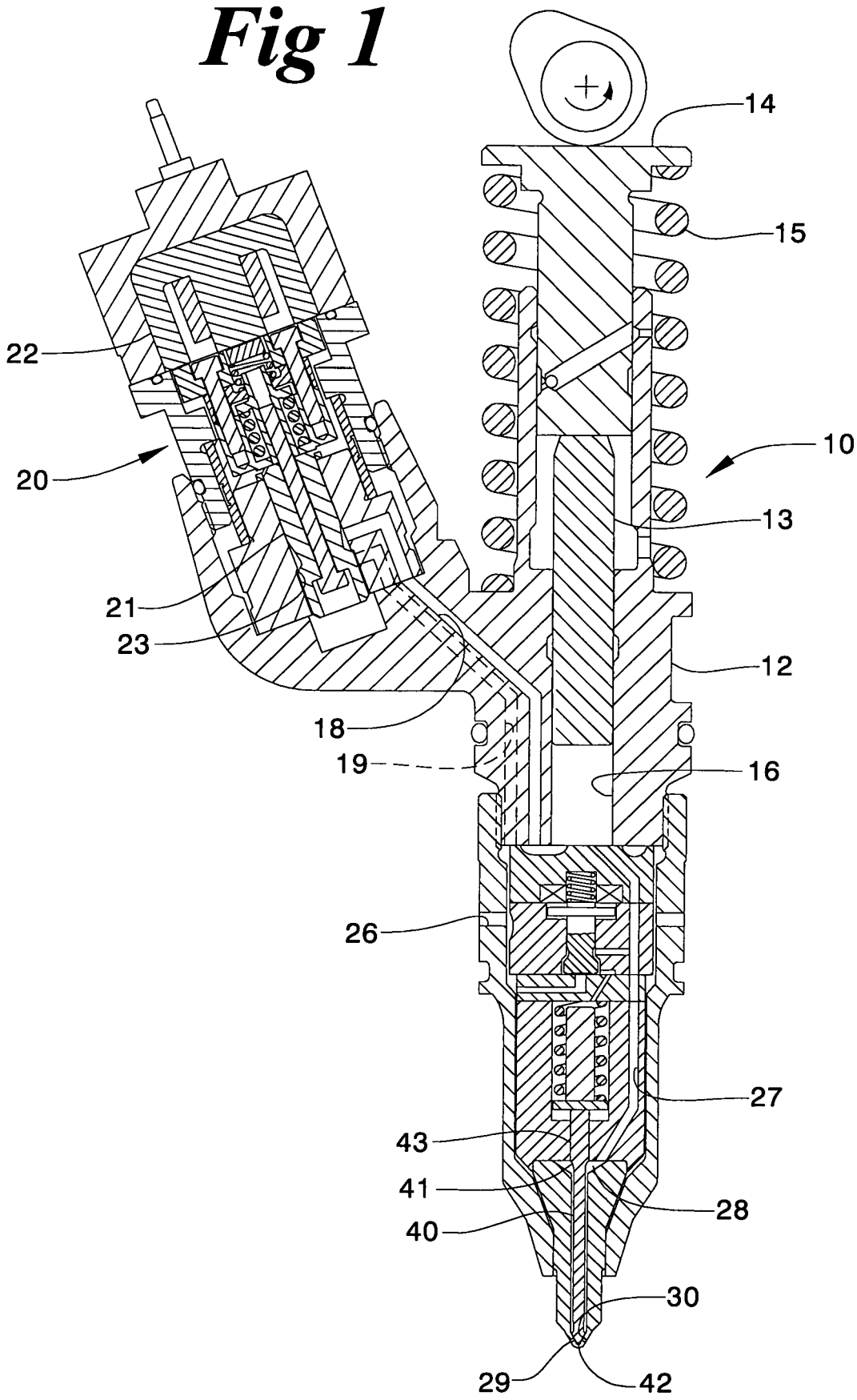
FIG. 1 is a sectioned side diagrammatic view of a fuel injector according to the present invention.
Figure 2:
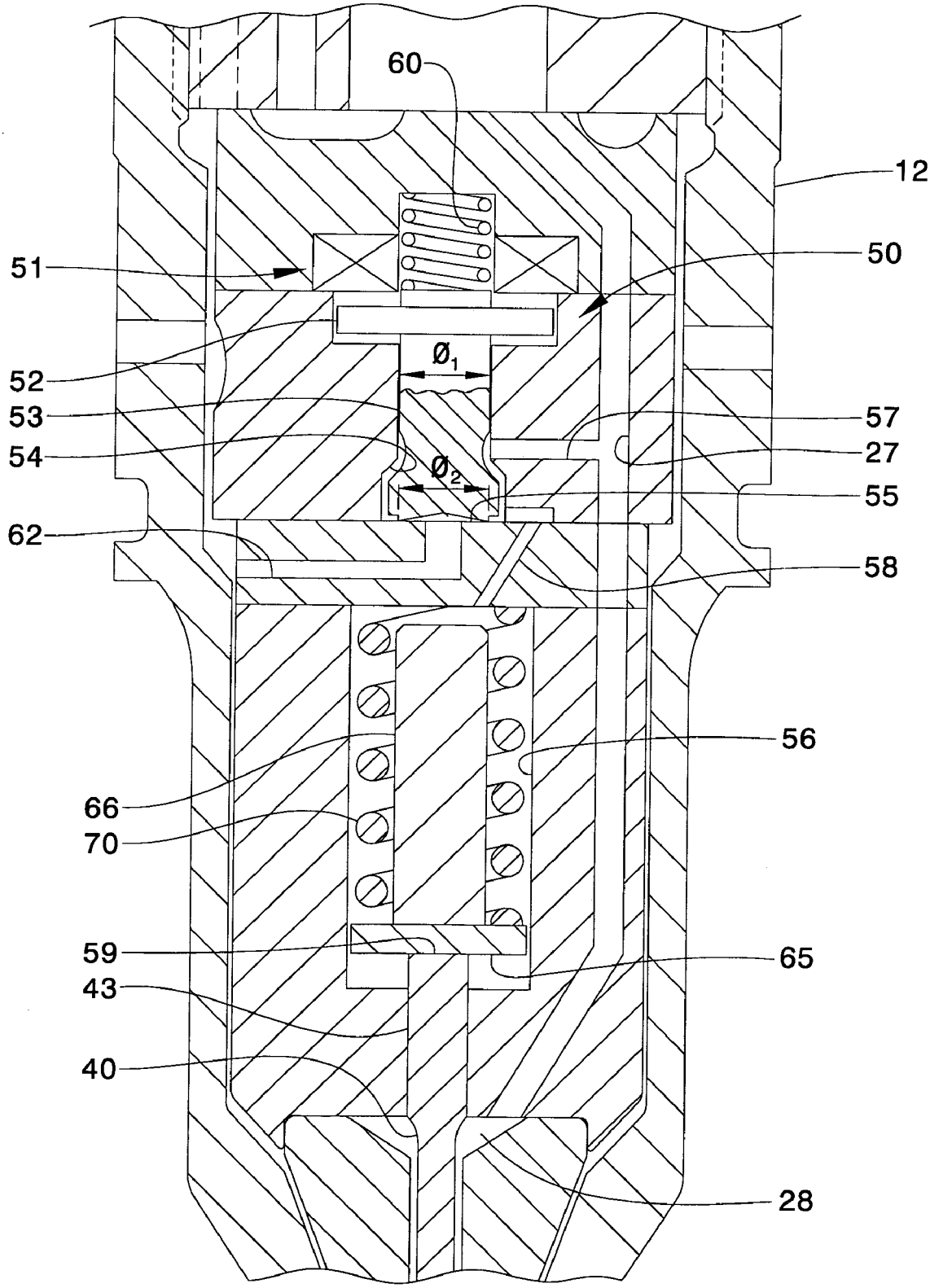
FIG. 2 is an enlarged side sectioned diagrammatic view of the needle control portion of the fuel injector of FIG. 1.

Referring to FIGS. 1 and 2, a mechanical electronically controlled unit injector 10 includes an injector body 12 that defines a fuel pressurization chamber 16 and a single nozzle outlet set 29. Fuel injector 10 is cam actuated and includes a tappet 14 that slides into injector body 12 to move a plunger 13 in a conventional manner. Tappet 14 includes a surface exposed outside of injector body 12 and is biased to its retracted position, as shown, by a return spring 15. Plunger 13 retracts via a moderate hydraulic force from the fuel supply pressure, which enters at fuel port 26 and is fluidly connected to fuel pressurization chamber 16 via spill return passage 19 and spill passage 18. When the rotating cam lobe causes tappet 14 to be depressed against the action of return spring 15, plunger 13 is driven downward to displace fluid from fuel pressurization chamber 16 at a relatively low pressure via spill passage 18 and spill return passage 19. At a desired timing, the fuel can be pressurized by actuating pressure control valve 20 by energizing a first electrical actuator 22 to move pressure control valve member 21 to close seat 23. This closes spill passage 18 to spill return passage 19, resulting in a relatively quick pressure rise in fuel pressurization chamber 16 due to the downward movement of plunger 13.

Fuel pressurization chamber 16 is fluidly connected to a nozzle chamber 28 via a nozzle supply passage 27. A one piece needle valve member 40 is partially positioned in nozzle chamber 28, and is biased downward into contact with needle valve seat 30 to close to single nozzle outlet set 29 via a biasing spring 70. One piece needle valve member 40 is formed or machined from a single solid metallic blank to include a uniform diameter guide portion 43 that separates a closing hydraulic surface 59 from a first opening hydraulic surface 41. Those skilled in the art will appreciate that single nozzle outlet set 29 could include one or more nozzle outlets, but all of the nozzle outlets belong to a single set. In other words, the present invention is not believed applicable to fuel injectors having two or more separate sets of nozzle outlets that are opened and closed via two or more needle valve members. Those skilled in the art will appreciate that first opening hydraulic surface 41 includes an annular ledge portion where the diameter of the needle valve member changes as well as including a portion of a slanted or rounded valve surface that is located above needle valve seat 30 when the needle valve member is in its closed position. Guide portion 43 has a relatively close clearance and a sufficient length to fluidly isolate needle control chamber 56 from nozzle chamber 28. Needle valve member 40 is normally biased downward such that it comes in contact with needle valve seat 30 to close nozzle outlet set 29. However, when in its upward open position, the needle valve member includes a second opening hydraulic surface 42 that is then exposed to fluid pressure in nozzle chamber 28. In other words, second opening hydraulic surface 42 consists substantially of that portion of needle valve member 43 that is at and below seat 30 when the needle valve member is in its downward closed position, as shown.

When needle valve member 40 is in its upward open position, it is hydraulically balanced, in that the effective hydraulic surface area of closing hydraulic surface 59 is equal to the combined affective surface areas of first and second opening hydraulic surfaces 41 and 42. In other words, guide portion 43 has a uniform diameter along its length. In order to establish the valve opening pressure for needle valve member 40, biasing spring 70 is chosen with a predetermined pre-load that is trimmed using a category part VOP spacer 65, which has a relatively large clearance to permit fluid displacement around its perimeter. It might alternatively include through holes to facilitate this fluid displacement. The maximum lift of needle valve member 40 is determined by needle stop component 66 that sits atop VOP spacer 65. When the needle valve member 40 lifts to its open position, needle stop component 66 comes in contact with the injector body component positioned above it.

The opening and closing of needle valve member 40 is controlled by a needle control valve 50, which is operably coupled to be actuated by a second electrical actuator 51 via movement of an armature 52. A needle control valve member 53 is trapped to move between a high pressure seat 54 and a low pressure seat 55, but is biased downward into contact with low pressure seat 55 via a biasing spring 60. Needle control valve member 53 is attached to move with, or is otherwise operably coupled to, armature 52 in a conventional manner. When needle control valve member 53 is in the downward position, as shown, needle control chamber 56 is fluidly connected to nozzle chamber 27 via pressure communication passage 58 and high pressure passage 57. Thus, when needle valve member 53, its diameter $\phi_1$ above high pressure seat 54 is preferably of a larger diameter than its lower portion below seat 54 indicated by diameter $\phi_2$.

Figure 4:
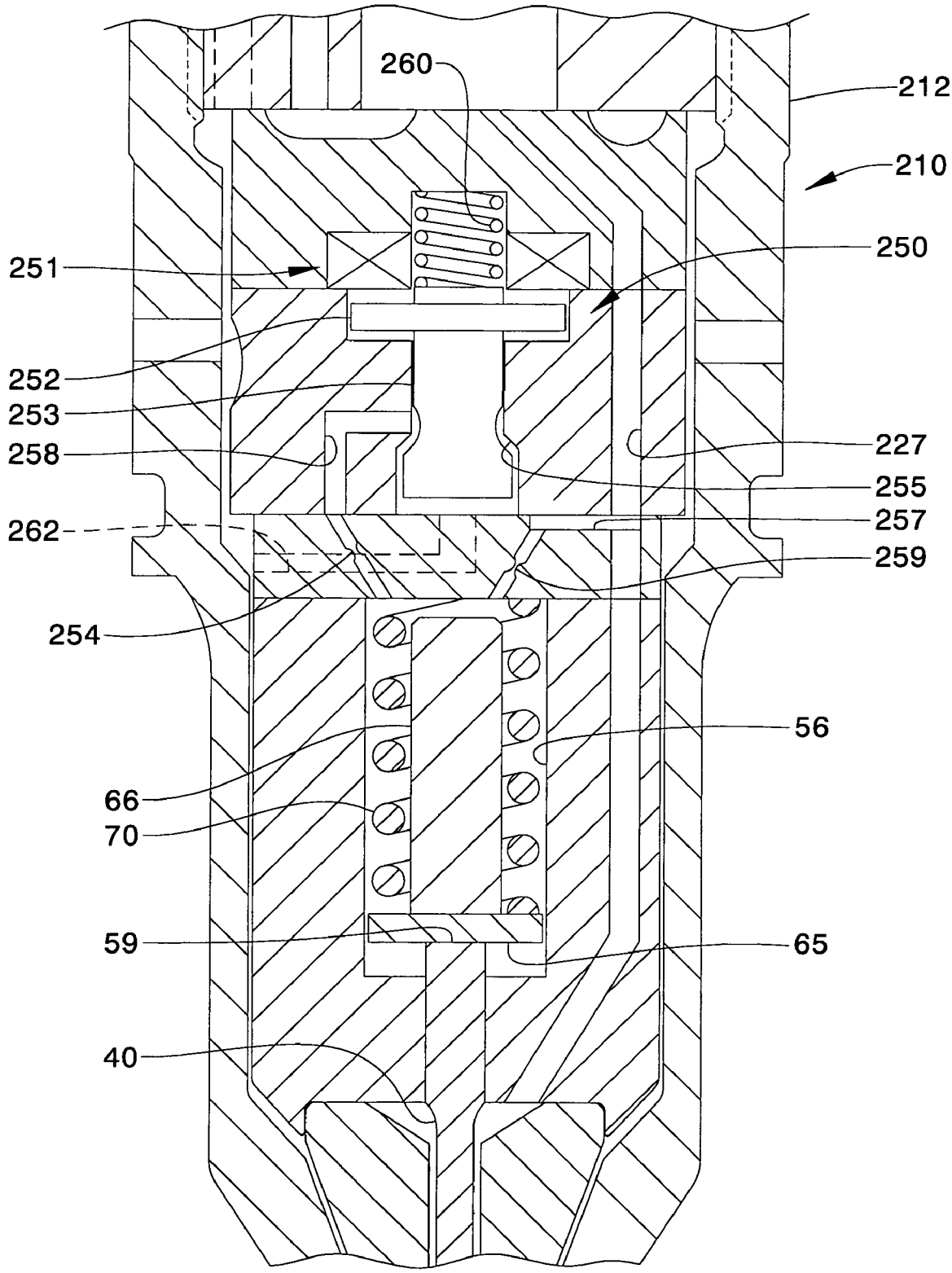
FIG. 4 is an enlarged sectioned side diagrammatic view of a needle control structure according to another aspect of the present invention.

Referring now to FIG. 4, still another embodiment of the present invention includes a fuel injector 210 that includes a two way needle control valve 250 attached to injector body 212 in a conventional manner. Those skilled control valve 50 is in this position, high pressure is communicated to needle control chamber 56 to act upon closing hydraulic surface 59, which will cause needle valve member 40 to stay in, or move toward, its downward closed position under the action of biasing spring 70. When second electrical actuator 51 is energized, needle control valve member 53 is lifted to its upward position to open low pressure seat 55 and close high pressure seat 54. When this occurs, needle control chamber 56 is fluidly connected to low pressure via pressure communication passage 58 and low pressure passage 62. When this occurs, needle valve member 40 will lift toward its upward open position if fuel pressure in nozzle chamber 28 is above a valve opening pressure sufficient to overcome biasing spring 70. When fuel pressure in nozzle chamber 28 drops below a valve closing pressure, the needle valve member 40 will stay in, or move toward, its downward closed position under the action of biasing spring 70. In order to reduce the affect of fluid flow and pressure on the movement of needle control valve member 53, its diameter $\phi_1$ above high pressure seat 54 is preferably of a larger diameter than its lower portion below seat 54 indicated by diameter $\phi_2$.

For example, in case of solenoid 51 failure, the valve member 53 will lift and open at some pressure that prevents over pressurization within the injector 10. Spring 60 preload can be adjusted to set the pop-off pressure. Therefore, valve member 53 has a net opening hydraulic surface when in its downward position, as in FIG. 2.

Figure 3:
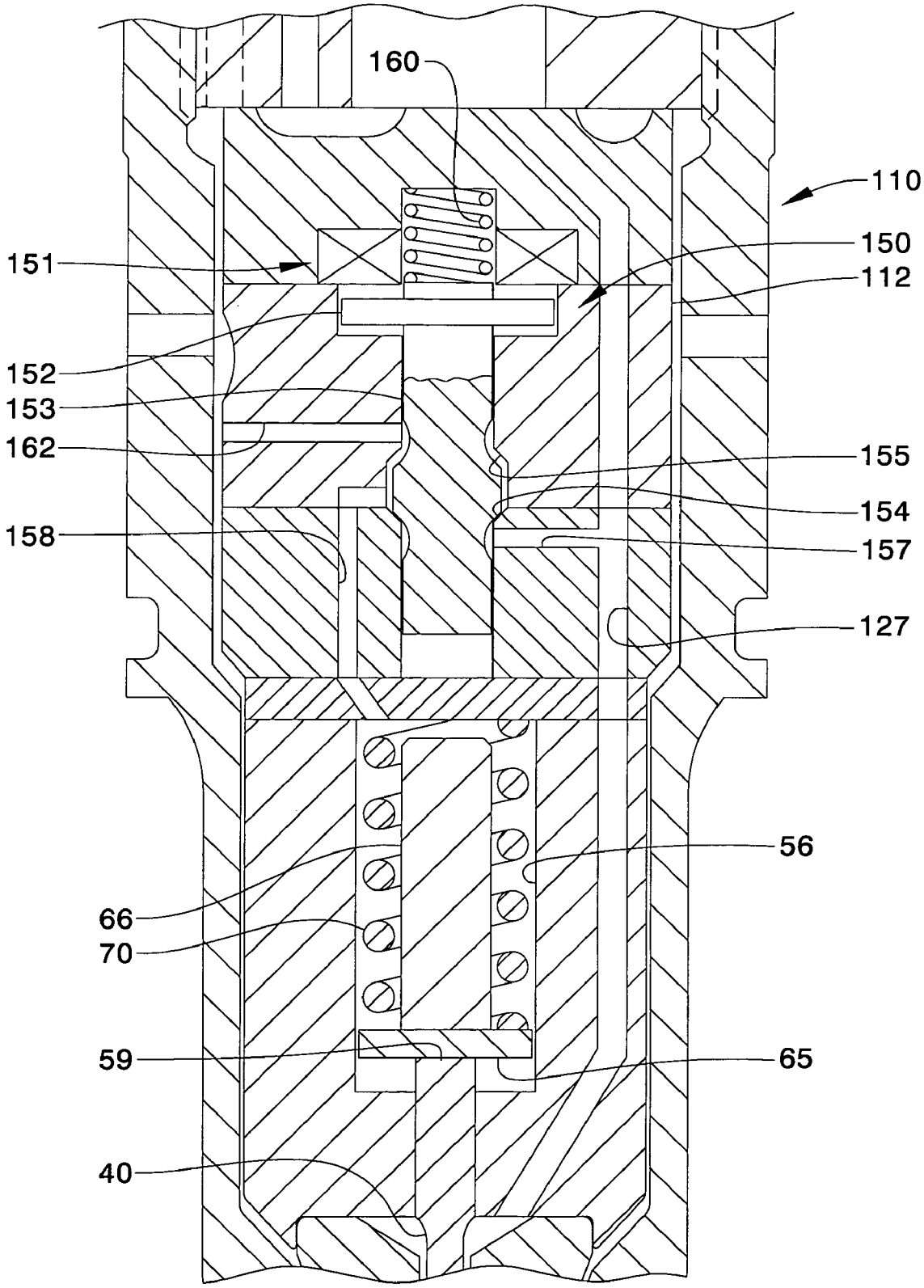
FIG. 3 is an enlarged sectioned side diagrammatic view of a needle control structure according to another aspect of the present invention.

Referring now to FIG. 3, a fuel injector 110 is very similar to fuel injector 10 previously described except for the structure of its needle control valve 150. Other features of fuel injector 110 that are identical to fuel injector 10 described earlier include identical numerals. Fuel injector 110 includes an injector body 112 that includes a nozzle supply passage 127 disposed therein. Needle control valve 150 includes a second electrical actuator 151 that includes an armature 152 attached to needle control valve member 153 in a conventional manner. Needle control valve member 153 is trapped to move between a low pressure seat 155 and a high pressure seat 154, but is normally biased downward into contact with high pressure seat 154 via a biasing spring 160. This embodiment differs from the previous embodiment in that the needle control valve member 153 is biased to close high pressure seat 154, whereas that previous embodiment was biased to close the low pressure seat 55. This results in the need for opposite control signals in order to pressurize the de-pressurize needle control chamber 56. In other words, when second electrical actuator 151 is de-energized, as shown, needle control chamber 56 is fluidly connected to low pressure drain passage 162 via pressure communication passage 158. When electrical actuator 151 is energized, armature 152 and needle control valve member 153 are lifted upward to open high pressure seat 154 and close low pressure seat 155 to fluidly connect needle control chamber 56 to the high pressure in nozzle supply passage 127 via pressure communication passage 158 and high pressure passage 157. Thus, the first and second embodiments both include three way needle control valves, but one is normally biased into contact to close the high pressure seat, whereas the other is biased to normally close the low pressure seat, resulting in the need to use opposite control signal energizations to produce the same affect in the respective fuel injectors.

Referring now to FIG. 4, still another embodiment of the present invention includes a fuel injector 210 that includes a two way needle control valve 250 attached to injector body 212 in a conventional manner. Those skilled in the art will appreciate that the needle control valve 250 is positioned to separate an upstream portion of a low pressure passage 258 from a downstream portion of a low pressure passage 262. Like the previous embodiments, the needle control valve 250 includes a second electrical actuator 251 with an armature 252 attached to move with a needle control valve member 253. Needle control valve member 253 is normally biased downward out of contact with seat 255 via a biasing spring 260. When in this position, needle control chamber 56 is fluidly connected to low pressure downstream passage 262 via low pressure upstream passage 258. Those skilled in the art will also recognize that needle control chamber 56 is always fluidly connected via an unobstructed high pressure passage 257 to nozzle supply passage 227. However, an A orifice 259 in high pressure passage 257 causes pressure in needle control chamber 56 to be relatively low since Z orifice 254, which is positioned in passage 258 has a larger flow area than A orifice 259. Z orifice 254 preferably has a flow area smaller than that across seat 255 to decrease sensitivity to variations in flow areas and performance variations among injectors. When needle control valve member 253 is lifted upward to close seat 255 by energizing electrical actuator 251, the low pressure passage 258 is closed and the pressure in needle control chamber 56 quickly approaches the pressure existing in nozzle supply passage 227. Thus, in the fuel injector of FIG. 4, the onset of an injection event can be delayed by energizing second electrical actuator 251, and injection events can be abruptly ended by energizing electrical actuator 251.

Figure 5:
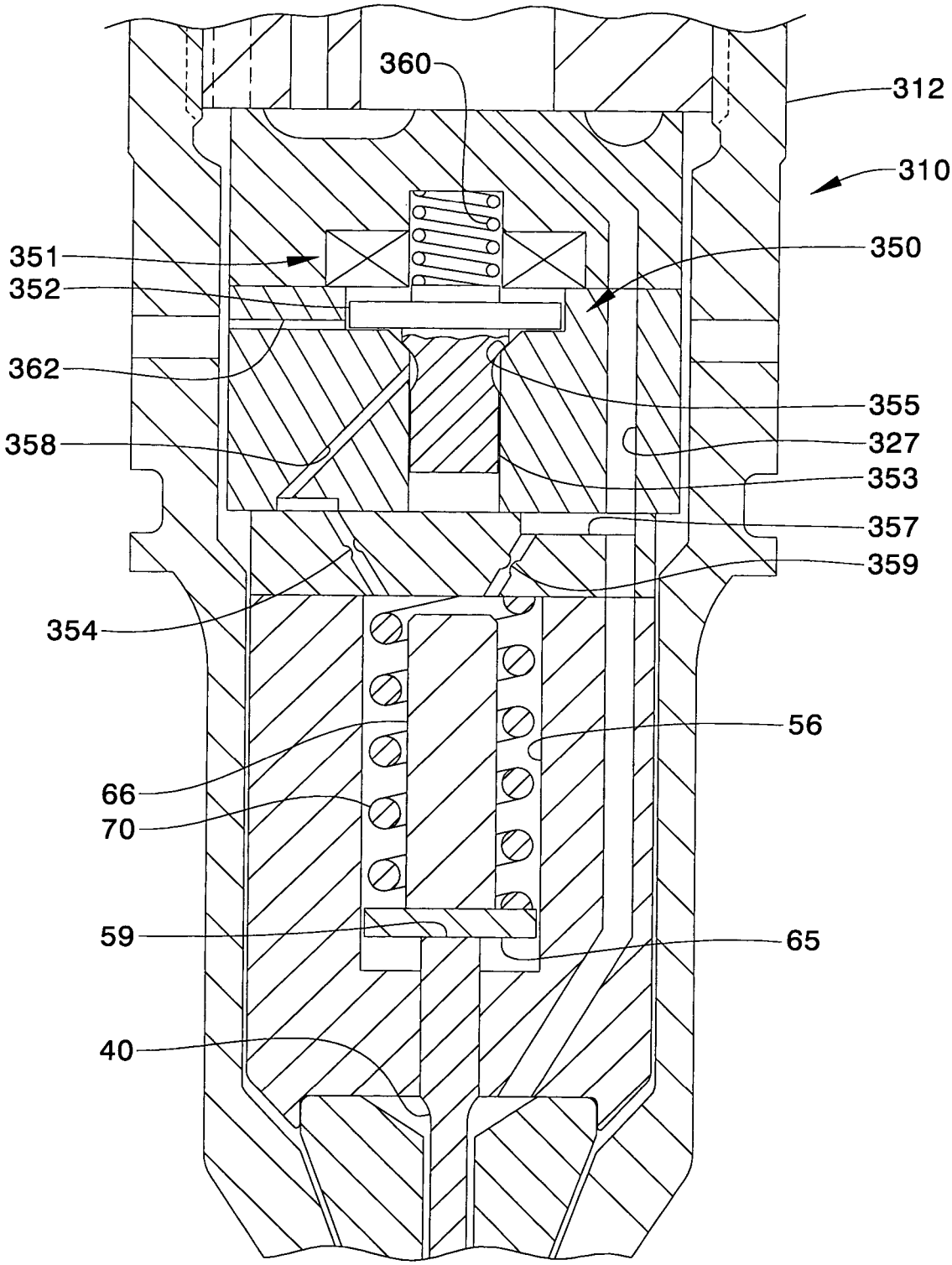
FIG. 5 is an enlarged sectioned side diagrammatic view of needle control structure according to still another aspect of the present invention.

Referring now to FIG. 5, a fuel injector 310 is substantially similar to the fuel injector 210 described with regard to FIG. 4 except that the needle control valve 350 is normally biased to close seat 355, whereas in the embodiment of FIG. 4, the needle control valve member was normally biased to open its seat 255. Thus, control signals for these two embodiments would be opposite of one another to produce the same or similar injection results. In other words fuel injector 310 includes an injector body 312 that includes a nozzle supply passage 327 disposed therein. The needle control valve 350 includes a second electrical actuator 351 with an armature 352 that is attached to move with needle control valve member 353. Needle control valve member 353 is normally biased downward into contact to close seat 355 by a biasing spring 360. Like the previous embodiment, needle control chamber 56 is always fluidly connected to nozzle supply passage 327 via an unobstructed high pressure passage 357 that includes a relatively small flow area orifice A orifice 359. Thus, when electrical actuator 351 is de-energized, the fluid pressure in needle control chamber 56 is about equal to the pressure in nozzle supply passage 327. When electrical actuator 351 is energized, needle control valve member 353 will move upward to open seat 355 to connect passage 358 to low pressure drain passage 362. Passage 358 includes a Z orifice 354 which may be a flow restriction relative to flow across seat 355, but is a larger flow area than A orifice 359 so that the movement of needle control valve member 353 can lower pressure in needle control chamber 56 allowing the needle valve member 40 to lift to spray fuel for an injection event.

INDUSTRIAL APPLICABILITY

All of the injectors according to the present invention can find potential application in reducing undesirable emissions from compression ignition engines. In addition, this can be accomplished with a reduced part count and complexity over other directly controlled fuel injectors of the prior art. In particular, the present invention reduces complexity in the area of the needle valve member by eliminating a needle piston (or a needle with a stepped guide region), which is common in prior art fuel injectors, and serves as a means of magnifying the pressure closing force on the needle valve member. In addition, the machining structure of the components in the vicinity of the needle valve member can be simplified over other similar fuel injectors that seek to minimize the fluid volume of the needle control chamber by positioning the needle's biasing spring elsewhere in the injector body. In other words, all versions of the present invention include a one piece needle valve member that is hydraulically balanced when in its upward open position, and include a needle biasing spring that is positioned in the needle control chamber, rather than elsewhere as per the conventional wisdom. While this structure can result in some lessening of fluid tightness with regard to the pressurizing and de-pressurizing the needle control chamber, the decrease in part count and complexity coupled with the still available superior performance and controllability options render the present invention more attractive over more expensive and more complex fuel injectors known in the art.

All of the illustrated fuel injectors can perform substantially similarly, but differ from one another in the use of either a two way or a three way needle control valve, and also differ from one another as to whether the needle control valve actuator needs to be energized or de-energized to control injection timing. In other words, an injection event in one of the injectors might require energizing the second electrical actuator, whereas the same control movement might require de-energizing the second electrical actuator in a different embodiment. Although the present invention has been illustrated in the context of a cam actuated electronically controlled fuel injector, those skilled in the art will appreciate that the present invention finds potential application in any fuel injector that undergoes cyclic high pressure and low pressure states during and between injection events, respectively. Such injectors include, but are not limited to hydraulically actuated fuel injectors that use fluid pressure to move a plunger, and common rail fuel injectors equipped with an admission valve that fluidly connects and disconnects the internal plumbing of the fuel injector to the high pressure common rail to perform an injection event. Thus, in the case of an admission valve alternative to the illustrated embodiments, the equivalent of closing the spill passage would be to open the admission valve to raise fuel pressure in the fuel injector.

By utilizing a one piece needle valve member that is hydraulically balanced when in its upward open position, the present invention allows for some control over the closure rate of the nozzle outlet set toward the end of an injection event. In other words, the closure rate of the needle valve member in most conditions will be based upon the preload of the needle valve member's biasing spring whereas the prior art closure rate is often coupled to the fuel pressure in the fuel injector, which can be a function of engine speed.

Because the pressurization and timing aspects of the injector control are somewhat independent of one another via separate first and second electrical actuators, the present invention can achieve some front and back end rate shaping control to advantageously allow for a reduction in undesirable emissions at certain engine operating conditions. While the base valve opening pressure of the needle valve member is set via the preload on the needle biasing spring, the present invention allows for control over the valve opening pressure to be anywhere between the base valve opening pressure and the maximum injection pressure. If it is desired for the needle valve member to open at the base valve opening pressure, the needle control chamber 56 is fluidly connected to the low pressure passage by a suitable positioning of the needle control valve prior to energizing the first electrical actuator to close the spill passage 18 to pressurize fuel in the fuel injector. If it is desired to raise the valve opening pressure above the base valve opening pressure, the needle control chamber can be closed to the low pressure passage while pressure is building in the fuel injector due to closure of the spill passage via energization of the first electrical actuator. When the pressure in the fuel injector reaches a desired level, the needle control chamber can be opened to the low pressure passage to relieve pressure on the closing hydraulic surface of the needle valve member and allow the same to lift upward to its open position to commence the spraying of fuel into the combustion space. Thus, the relative timing in actuating the first and second electrical actuators can not only affect the valve opening pressure at the beginning of an injection event but also be exploited to affect the initial injection rate depending upon the engine operating condition to further lower undesirable exhaust emissions. Those skilled in the art will appreciate that the ability to control fuel pressure at the beginning and end of the injection event is equally applicable to other types of fuel injectors that raise and lower fuel pressure at the beginning and end of injection events, respectively. For instance, hydraulically actuated fuel injectors raise fuel pressure by opening the fuel injector to a high pressure actuation fluid supply, and reduce fuel pressure at the end of an injection event by closing that fluid connection to the high pressure actuation fluid supply. Likewise, a common rail fuel injector equipped with an admission valve raises fuel pressure in the injector by opening the admission valve and reduces fuel pressure by closing the same, and opening a spill passage, at the end of an injection event.

The present invention has the ability to allow the injection event to be initiated at a selected fuel pressure between a base valve opening pressure and a maximum injection pressure, and also allows the injection event to be ended at a selected fuel pressure between the maximum injection pressure and the base valve closing pressure. Recalling that the base valve opening pressure and the base valve closing pressure are based upon the preload of the needle biasing spring 70. Because the needle valve member is hydraulically neutral or balanced when in its upward open position, the closure rate of the needle valve member can also be adjusted by selecting a particular spring preload since the hydraulic forces are balanced on the needle when the spring alone pushes the needle toward its closed position to end an injection event. In addition, by selecting a particular spring preload, the base valve opening pressure can be selected along with affecting the opening rate of the needle valve member to allow the fuel injector to perform front end rate shaping by affecting the opening rate of the needle valve member toward the beginning of an injection event. Apart from the ability of the fuel injectors according to the present invention to selectively control front end and back end rate shaping via selecting a particular spring preload along with relative timing in the actuation and de-actuation of the first and second electrical actuators, the fuel injectors of the present invention can also produce split injections. This is accomplished by moving the needle control valve from a position in which the needle control chamber is fluidly connected to a low pressure passage, closing that fluid connection, and then reopening the fluid connection between the needle control chamber and the low pressure passage while fuel pressure in the injector is above the base valve opening pressure. This is accomplished by maintaining the first electrical actuator energized to maintain the spill passage closed while the needle control valve is moved back and forth between positions. In other words, split injections are normally accomplished by maintaining fuel pressure in the injector high while moving the needle valve member via back and forth movement of the needle control valve to relieve, apply and then again relieve pressure on the closing hydraulic surface of the needle valve member. When the dwell between injection events is longer, the present invention also allows for some rate shaping affects at least in part by moving the pressure control valve alone or at some relative timing respected to moving the needle control valve to produce the pressure changing effects described above.

Fuel injectors according to the present invention can be thought of as having at least three different nozzle closure modes. In a first mode, the needle control chamber is maintained opened to the low pressure passage and the needle moves toward its closed position when fuel pressure drops below a valve closing pressure after the first electrical actuator has been de-energized to open the spill passage and lower fuel pressure in the injector. Thus, in this first closure mode, the needle behaves much like a simple spring biased check valve associated with many fuel injectors known in the art. In a second closure mode, the pressure forces on the needle valve member are hydraulically balanced by closing the needle control chamber to the low pressure passage. When this is done before the first electrical actuator has been de-energized to open the spill passage and lower fuel pressure, the fuel injection event can be relatively abruptly ended while fuel pressure remains high. Although the needle valve member is hydraulically balanced, it will move toward its closed position under the action of the biasing spring 70 substantially alone. In a third closure mode, the needle valve member is hydraulically balanced after the first electrical actuator has been energized to open the spill passage to lower fuel pressure. Thus, in the third closure mode, fuel pressure in the injector is dropping, but is still above the base valve closing pressure determined by the hydraulic surface areas and preload of biasing spring 70. Thus, in the third closure mode, the needle can be made to move toward its closed position at a desired timing as fuel pressure is dropping due to the opening of the spill passage. In other fuel injectors, the fuel pressure drop is accomplished by moving an admission valve toward a closed position in the case of the common rail fuel injector while simultaneously connecting the injector to a low pressure return passage, or closing an actuation fluid valve in the case of a hydraulically actuated fuel injection. Depending upon the particular engine operating condition, one of these closure modes can be selected to reduce undesirable emission at that particular operating condition.

Thus, the fuel injectors of the present invention have performance capabilities approaching and sometimes exceeding more complicated fuel injectors with direct pressure control over the needle valve member. In those fuel injectors, the opening and closure rates of the needle valve member are more coupled to the fuel pressure existing in the injector at that time than they are to the selection of spring preloads as in the present invention. Thus, the present invention not only allows for the elimination of some costly machining and a reduction in part count, but also allows for a more expanded range of capabilities with only a slight potential compromise in needle control fluid tightness over some fuel injectors with extremely small volume needle control chambers. However, this aspect of the invention can also be affected by choosing a VOP spacer and needle stop component that occupy much of the volume in the needle control chamber so that the fuel injectors of the present invention can approach the fluid tightness and minute timing control capabilities of some prior art fuel injectors with direct pressure control over the needle valve member movement. The present invention also subtly disassociates an aspect of the control circuit from engine speed. In many cases, the fuel pressure (i.e. control pressure) within the injector will be at least indirectly related to engine speed. In other words, at high engine speeds, a tappet is driven faster and so higher fuel pressures are achieved. When the engine is operating slower, the tappet is driven at a slower rate and results in lower fuel pressures. In many prior art fuel injectors, the needle control aspect of the injector is controlled via the fuel pressure, and hence the rates at which the needle moves toward its open and closed position is indirectly related to engine speed. The present invention, on the other hand, relies primarily on a spring pre-load in order to set opening and closure rates of the needle valve member, even though the fuel injector experiences fuel pressures that are a function of engine speed as in many prior art fuel injectors.

It should be understood that the above description is intended for illustrative purposes only, and is not intended to limit the scope of the present invention in any way. For instance, although the invention has been illustrated with solenoid actuators, other electrical actuators such as piezo actuators, could be substituted. Thus, those skilled in the art will appreciate that other aspects, objects, and advantages of the invention can be obtained from a study of the drawings, the disclosure and the appended claims.

What is claimed is:

1. A method of operating a fuel injector, comprising the steps of:

raising fuel pressure in a nozzle chamber at least in part by energizing a first electrical actuator;

opening a single nozzle outlet set of the fuel injector for each of a first injection event, a second injection event and a third injection event respectively at a selected timing at least in part by positioning a needle control valve at a first position that fluidly connects a needle control chamber to a low pressure passage;

closing the single nozzle outlet set at a selected timing after the opening step for the first injection event including de-energizing the first electrical actuator to move a pressure control valve to a first position that opens the nozzle chamber to a spill passage while maintaining the needle control valve in the first position;

closing the single nozzle outlet set at a selected timing after the opening step for the second injection event including equalizing opening and closing hydraulic pressure forces on a needle valve member to move the needle valve member toward a closed position with a spring force by moving the needle control valve to a second position that fluidly closes the needle control chamber to the low pressure passage before de-energizing the first electrical actuator;

closing the single nozzle outlet set at a selected timing after the opening step for the third injection event including equalizing opening and closing hydraulic pressure forces on the needle valve member to move the needle valve member toward the closed position with the spring force by moving the needle control valve to the second position after de-energizing the first electrical actuator.

2. The method of claim 1 wherein the opening a single nozzle outlet set step includes a step that is one of:

energizing and de-energizing a second electrical actuator to move the needle control valve from a second position to the first position.

3. The method of claim 1 wherein the needle control valve is positioned in the first position before the step of energizing the first electrical actuator.

4. The method of claim 1 wherein the opening a single nozzle outlet set step is performed at a selected valve opening pressure at least in part by one of energizing and de-energizing a second electrical actuator to move the needle control valve from the second position to the first position a predetermined timing after the step of energizing the first electrical actuator.

5. The method of claim 1 including a step of producing a split injection at least in part by moving the needle control valve from the first position to the second position and then back to the first position while the first electrical actuator remains energized before performing the closing step for one of the first injection event, the second injection event and third injection event.

6. The method of claim 1 wherein the step of closing the single nozzle outlet set is performed at a selected valve closing pressure at least in part by moving the needle control valve from the second position to the first position at a predetermined timing relative to de-energizing the first electrical actuator.

7. The method of claim 1 including a step of maintaining a unobstructed fluid connection between the needle control chamber and the nozzle chamber via an A orifice.

8. The method of claim 7 wherein the step of opening a single nozzle outlet set includes a step of fluidly connecting the needle control chamber to a low pressure passage via a Z orifice having a larger flow area than the A orifice.

9. The method of claim 1 wherein the raising fuel pressure step includes a step of moving a plunger into a fuel pressurization chamber within the fuel injector.

10. The method of claim 9 wherein the step of moving a plunger is accomplished at least in part by moving a tappet into the fuel injector.

* * * * *

UNITED STATES PATENT AND TRADEMARK OFFICE

CERTIFICATE OF CORRECTION

PATENT NO. : 7,455,243 B2
APPLICATION NO. : 10/792169
DATED : November 25, 2008
INVENTOR(S) : Dana R. Coldren It is certified that error appears in the above-identified patent and that said Letters Patent is hereby corrected as shown below:

Title Page, item (75), under "Inventors", in Column 1, Line 3, delete "Pontiac," and insert -- Morton, --.

Signed and Sealed this

Twenty-fourth Day of March, 2009

JOHN DOLL
*Acting Director of the United States Patent and Trademark Office*